US010976127B2

(12) United States Patent
Adika

(10) Patent No.: US 10,976,127 B2
(45) Date of Patent: Apr. 13, 2021

(54) ACCESSORY ATTACHMENT SYSTEM FOR A HANDGUN HAVING A POLYMER SLIDE COVER

(71) Applicant: Dorin M. Adika, Coral Springs, FL (US)

(72) Inventor: Dorin M. Adika, Coral Springs, FL (US)

( * ) Notice: Subject to any disclaimer, the term of this patent is extended or adjusted under 35 U.S.C. 154(b) by 3 days.

(21) Appl. No.: 16/738,366

(22) Filed: Jan. 9, 2020

(65) Prior Publication Data

US 2020/0278166 A1 Sep. 3, 2020

Related U.S. Application Data

(60) Provisional application No. 62/791,561, filed on Jan. 11, 2019.

(51) Int. Cl.

| | |
|---|---|
| ***F41A 21/48*** | (2006.01) |
| ***F41A 11/02*** | (2006.01) |
| ***F41A 3/66*** | (2006.01) |
| ***F41C 27/00*** | (2006.01) |

(52) U.S. Cl.

CPC ..... *F41A 21/488* (2013.01); *F41A 3/66* (2013.01); *F41A 11/02* (2013.01); *F41C 27/00* (2013.01)

(58) Field of Classification Search

CPC ..... F41A 21/488; F41A 3/66; F41A 11/02; F41C 27/00

USPC ..... 42/77

See application file for complete search history.

(56) References Cited

U.S. PATENT DOCUMENTS

| | | | | |
|---|---|---|---|---|
| 2,436,601 | A | 3/1948 | Davis | |
| 2,438,601 | A * | 3/1948 | Davis | 42/137 |
| 4,338,740 | A | 7/1982 | Miller | |
| D269,989 | S | 8/1983 | Ross | |
| 4,418,487 | A | 12/1983 | Strahan | |
| 4,628,611 | A * | 12/1986 | Ruffino | F41G 1/16 42/137 |
| D291,470 | S | 8/1987 | Bechtel | |
| 4,899,479 | A | 2/1990 | Sanders | |
| D318,313 | S | 7/1991 | Bechtel | |
| 6,327,806 | B1 | 12/2001 | Paige | |

(Continued)

FOREIGN PATENT DOCUMENTS

DE 3109786 A1 12/1982

OTHER PUBLICATIONS

"Rock Slide G32 Gen 3 Upper" product listing retrieved on Sep. 2, 2020 from https://rockslideusa.com/product/rock-slide-g32-gen-3-upper/ (Year: 2020).*

(Continued)

*Primary Examiner* — Samir Abdosh

(74) *Attorney, Agent, or Firm* — Greenspoon Marder LLP

(57) ABSTRACT

Disclosed is an accessory attachment system for a slide-action handgun having a slide cover with side holes, a mounting flange, and a flange lock pin. The slide cover includes a front end, a rear end, an upper surface, a right and left side that cover a slide mechanism of the firearm. The mounting flange is inserted into the upper surface of the slide cover for receiving and securing a handgun accessory. The mounting flange has a bottom surface configured to secure the accessory attached to the mounting flange to the underlying slide mechanism of the slide action handgun using the flange lock pin.

15 Claims, 4 Drawing Sheets

(56) References Cited

U.S. PATENT DOCUMENTS

| | | | | |
|---|---|---|---|---|
| 7,827,720 | B1 * | 11/2010 | Erdem | F41A 17/72 42/70.08 |
| 8,468,734 | B2 | 6/2013 | Meller et al. | |
| 8,607,495 | B2 | 12/2013 | Moore et al. | |
| 9,267,759 | B2 | 2/2016 | Speroni | |
| 9,285,186 | B1 | 3/2016 | Di Veroli et al. | |
| 9,303,955 | B2 | 4/2016 | Jeung et al. | |
| 9,328,991 | B2 | 5/2016 | Gale et al. | |
| 9,470,480 | B2 * | 10/2016 | Kirchhoff | F41G 11/001 |
| 9,506,726 | B2 | 11/2016 | Wolf | |
| 9,696,114 | B1 | 7/2017 | Cabrera et al. | |
| 9,958,234 | B2 | 5/2018 | Campean | |
| 2004/0211105 | A1 | 10/2004 | Arachequesne | |
| 2014/0053445 | A1 | 2/2014 | Wolf | |
| 2014/0230305 | A1 * | 8/2014 | Zimmer | F41C 3/00 42/111 |
| 2016/0245602 | A1 | 8/2016 | Hangen | |
| 2017/0059277 | A1 * | 3/2017 | Justice | F41G 11/003 |

OTHER PUBLICATIONS

B., Eric, "DAA C-More RTS2 2011 Scope Mount," TFB—The Firearm Blog, thefirearmblog.com, Aug. 14, 2017. https://www.thefirearmblog.com/blog/2017/08/14/daa-c-rts2-2011-scope-mount/ 8 pages.

"45. Longslide with Laser Products sight, update," RPF, therpf.com, started by Demetrius, Feb. 2, 2012. https://www.therpf.com/forums/threads/45-longslide-with-laser-products-sight-update.138655/ 23 pages.

"FAB Defense Universal Picatinny Scope Mount for Pistols with Accessory Rails," Midway USA, midwayusa.com/product/1004113623/fab-defense-universal-picatinny-scope-mount-for-pistols-with-accessory-rails 8 pages.

"Red Dot FN 57 RMR Mount & Optics for Sale: Trijicon, Burris," FN57 Sale, fn57sale.com/, 2018. https://fn57sale.com/product/red-dot-fn-57/ 5 pages.

Patent Cooperation Treaty, PCT International Search Report and Written Opinion, dated Apr. 2, 2020, 11 pages.

* cited by examiner

ACCESSORY ATTACHMENT SYSTEM FOR A HANDGUN HAVING A POLYMER SLIDE COVER

This application claim priority to pending provisional application No. 62/791,561 filed Jan. 11, 2019 entitled An Improved Accessory Attachment System for a Hand Gun Having a Polymer Slide Cover.

FIELD OF INVENTION

This invention generally relates to the field of after-market modifications to certain types of firearms to accommodate accessories that enhance the firearm's performance. More specifically, this invention provides the ability to adapt third-party optical devices to handguns such as the FN 5.7 pistol. The first small arms were manufactured and designed under NATO's requirements as set forth in 1989. One of the key objectives of the NATO specifications was to improve the accuracy and efficiency of handguns used by the military and police.

Modern-style handguns vary significantly from older, revolver-style handguns. The modern-style, semi-automatic handgun incorporates a gas-powered slide mechanism that encases the barrel and uses the recoil force and/or expanding gases from the discharge to eject the spent cartridge and reload a fresh cartridge into the chamber. The fresh cartridges are typically housed in a spring-loaded magazine that is inserted into the grip handle of the firearm. Precision machined rails and a plurality of springs maintain stable motion of this slide mechanism backwards and forwards allowing rapid successive firing.

On initial preparation for firing, these style handguns typically require the shooter to manually pull the slide mechanism backwards to draw a fresh cartridge up from the handle magazine. An opposing spring located near or around the barrel causes the slide mechanism to move forward when released, which pushes the cartridge into the firing chamber and sets the firearm ready for discharge on triggering. When discharged, the expanding gases from the cartridge detonation cause the slide mechanism to move backwards. An opposing barrel spring is compressed by this motion and returns the slide mechanism forward after cartridge detonation. The motion of the slide, the ejection of the spent cartridge, the compression of the barrel spring and the reloading of the fresh cartridge all serve to absorb much of the energy of the cartridge detonation, which ultimately serves to reduce the remaining recoil forces the shooter must absorb in their body while holding the firearm. In many designs, when the handle magazine is empty of fresh cartridges, a mechanism locks the slide into the fully retracted position to alert the shooter of an empty magazine and present the firearm in a position to rapidly prepare the weapon for firing when a fresh loaded magazine is inserted.

BACKGROUND OF THE INVENTION

The slide mechanism of modern-style handguns is primarily comprised of an inverted U-shaped steel shell having precision-machined tips that match channel rails machined into the bottom handle assembly. This machined rail system allows the slide mechanism to only move backwards and forwards in a precisely restricted manner during discharge. The handgun is rated for up to 20,000 firings before component replacements may be required due to wearing of metal-to-metal contact points, such as the slide mechanism rail system. In order to improve the aesthetics of the handgun, reduce the handgun's weight, and to protect the slide mechanism rail system from fouling agents, some modern style handguns, encase the slide mechanism in a cover. For many designs, this cover is made of machined metal that is secured to the slide mechanism at one or more points by push pins or other hardware, which allows the slide mechanism and cover to move as one assembly.

For metallic covers, aiming optics such as dot-sights, are attached to the top surface of the cover. Metallic slide covers may add significant weight to the firearm. Also, in policing circumstances for example, they can provide a light-reflective surface, which allow the presence of the weapon to be observed by an assailant. There is a need of a weapon that addresses both of these issues by incorporating a dark-colored, dense polymer material as the slide cover. The dense polymer cover is lighter than steel and absorbs light. One drawback of using a dense polymer material for the slide cover is that add-on devices, such as aiming optics, cannot be affixed reliably to the cover. The handgun addresses this issue by affixing the dot-sights into dovetails machined into the slide mechanism itself and the polymer cover has cutouts that fit over and around the dot-sights.

Another drawback to slide covers, in general, is that they typically require physical machining to accommodate different attachments, such as laser optics made by third parties. Laser optics are often preferred additions to the firearm since they are less accurate than rifles and dot-sights typically require extensive training to master. Many third-party laser optic designs require picatinny mounting rails to be affixed somewhere on the firearm. Most modern style handgun manufacturers incorporate a short picatinny rail attached to the underside of the barrel. In many cases, shooters attach a laser optic aiming device to this under-barrel rail. However, this is a problematic location to place the laser optic device for at least a few reasons. First, the barrel-end is subjected to the largest percussive force during discharge, which tends to loosen overtime the attachment fasteners of the laser optic on the picatinny rail. Second, the shooter cannot view the laser dot in the line-of-sight aiming point since the beam is projected to the target from under the barrel. Third, other optic devices such as red-dot optics and mini-scopes, which do not project an observable light beam directly on the target, are required to be line-of-sight mounted.

A preferred method of mounting precision optics onto a moving slide would be to incorporate a flange specifically designed to accommodate a guide and fastener pattern tailored to the manufacturer and securing the flange directly to the moving slide. However, adding custom mounting flanges to the upper surface of a handgun's slide rail cover to accommodate after-market accessories often requires either replacing the slide cover entirely, removing the firearm's existing rear sight to utilize the firearms existing dovetail, or costly gunsmithing. This problem is further exacerbated with the current models since the slide cover is made from a dense polymer, which is not a well-suited material for directly mounting precision optics.

What is needed in the art is an accessory attachment system for attaching a durable mounting flange for accessories, such as line-of-sight optics, on the top side of the firearm without requiring costly replacement of critical components that might affect the design performance and warranty of the weapon. Additionally, an accessory attachment system for reliably attaching such accessories to the slide without requiring costly gunsmithing or custom machining is also needed. What is further needed in the art is an accessory attachment system for gun owners to readily customize their weapon to aftermarket accessories without requiring specialized gun-working skills or tools.

SUMMARY OF THE INVENTION

In accordance with teachings of the present invention an accessory attachment system also called an accessory attachment system for a slide-action firearm is provided. The accessory attachment system includes a slide cover with a front end, a rear end, a top surface, a right side and a left side, a rear cutout in the top surface for attaching a removable mounting flange, and a right side cutout and left side cutout to house a lock pin having a proximal and distal end that is used to secure the mounting flange and slide cover to the underlying factory slide mechanism; wherein the lock pin is inserted into the right side cutout and the distal end of the lock pin terminates in the left side cutout; further wherein the removable mounting flange is configured for receiving and securing a firearm accessory and attaching to the firearm using the lock pin. More specifically, the removable mounting flange includes a top planar surface with fastening devices to attach various firearm accessories and a bottom surface that includes a pair of anchor legs. The pair of anchor legs comprise a first anchor leg and a second anchor leg that are spaced apart to straddle the interior factory slide mechanism wherein each anchor leg has a hole that aligns with a hole in the slide mechanism and with the right side cutout and left side cutout that house the lock pin of the slide cover. The lock pin is inserted through the right side cutout, passes through the first anchor leg hole of the removable mounting flange, into and through a hole in the factory slide mechanism, through the second anchor leg hole of the removable mounting flange and terminates in the left side cutout of the slide cover.

The terms "cutout" "opening" and "hole" are used herein interchangeably. The terms "side bolt" "lock pin" "flange fastener" "flange lock pin" and "horizontal flange fastener" are used herein interchangeably. The terms "gun" and "handgun" "pistol" "weapon" and "firearm" are used herein interchangeably. The terms "slide" "slide assembly" and "slide mechanism" are also used herein interchangeably. The terms "upper surface" and "top surface" are used herein interchangeably. The terms "accessory attachment system" and "slide cover system" are herein used interchangeably.

The present invention is directed to an accessory attachment system for attachment to the handgun slide assembly. More specifically, the accessory attachment system covers the factory slide mechanism of the firearm. In addition, the slide cover is made from lightweight materials and replaces the factory existing slide cover of the existing firearm without affecting the design or performance of the weapon. The present invention does not require any modifications to the existing firearm so long as the factory slide mechanism has a hole for the lock pin. Where the factory slide mechanism does not have a hole, a hole can be made or machined. Alternatively, the slide mechanism can be replaced with one that has a hole for receiving the lock pin. Moreover, the accessory attachment system allows existing dot-sights incorporated into the firearm by the original manufacturer to remain yet provides a durable and stable mounting point required for accessories such as precision aiming optics.

In the present invention, the removable mounting flange is made of a rigid material such as metal or metal alloy and incorporates hardware such as the flange lock pin and one or more set screws that secure the mounting flange to the slide cover and slide mechanism to maintain the positioning of the mounted accessory. Examples of handgun accessories include aiming optics such as dot-sights, laser optics, red-dot optics, mini-scopes etc. In one embodiment, the invention includes a cover plate to cover the cutout for the removable flange in the upper surface of the slide cover when the optic or other accessory is not in use.

In one embodiment, of the invention, the removable mounting flange is readily removable or replaceable to accommodate a variety of mounting patterns that may be unique to a particular accessory and/or manufacturer. In one embodiment, the removable mounting flange comprises a top plate and bottom plate that slidably connected one to the other to move the top plate forward and backward along the slide cover upper surface. In one embodiment, the accessory attachment system includes a cut-out section at the front and rear end of the slide cover to accommodate protrusions from accessories attached to the slide mechanism; and a side cut-out to accommodate a shell ejection port of the sliding mechanism.

In one embodiment, the accessory attachment system can be constructed from the same or similar materials used by the firearm manufacturers to be aesthetically pleasing and give the impression the accessory attachment system is a standard stock or factory component integral to the firearm. The slide cover is manufactured from a durable, lightweight polymer. In another embodiment, the accessory attachment system further includes a plurality of grooves on the front and rear end of the slide cover to improve grip and handling. In another embodiment, the invention is an aftermarket system designed to accommodate a wide variety of aftermarket optics and accessories without the use of professional gunsmithing skills, without removing the factory rear sight, and without permanent modification of the firearm.

DETAILED DESCRIPTION OF THE INVENTION

The present invention presents a device of components that when combined, allow a modern slide-action firearm with a polymer slide cover to be readily modified to accommodate after-market accessories, without requiring specialized gunsmith skills or compromising the performance of the handgun as designed by the original manufacturer. The present invention also presents improvements to how the slide cover is secured to a factory slide mechanism as compared to the push pin style fastener used by the original manufacturer. The present invention allows for alternate embodiments of a removable mounting flange to accommodate a wide variety of accessory mounting configurations and designs.

The present invention also provides improved mounting stability which is critical, especially when optics accessories are incorporated, and the mounting surface is being subjected to rapid and repeated motion. The present invention also allows the shooter of the handgun to readily reconfigure the firearm accessories while in the field and does not require disassembly of major gun components nor any permanent modification to the firearm. The present invention also leaves in place any original sights incorporated into the firearm by the manufacturer and allows the shooter to readily install, for example, accessories such as but not limited to optic devices and systems that enhance shooting accuracy.

The present invention comprises a modified polymer slide cover that replaces the original manufacturer's slide cover, a rigid but removable mounting flange having fasteners and a fastener pattern optimized for the type of accessory being added, a lock pin that is inserted into the side of the slide cover for supporting and securing the rigid mounting flange to the factory slide of the handgun, and at least one additional fastener such as set screw to attach the removable mounting flange to the underlying slide mechanism.

Figure 1A:
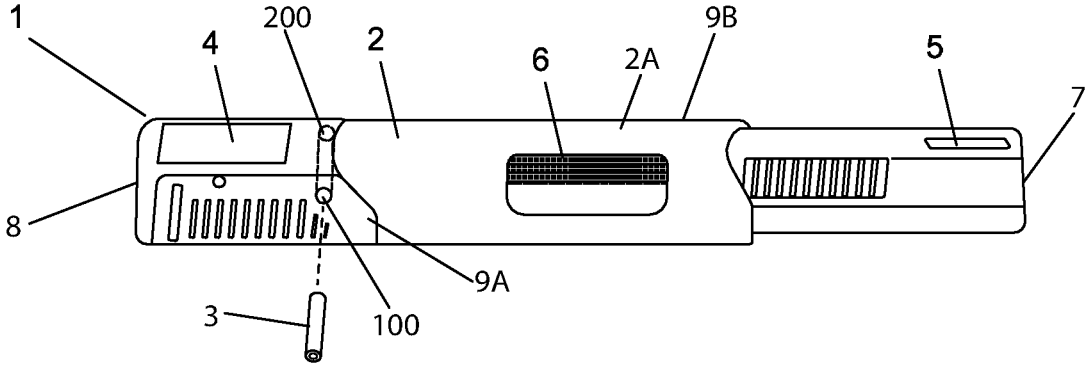
FIG. 1A is a top-left side perspective view of a factory slide cover.

FIG. 1A shows one embodiment of a factory slide cover device 1 for a slide-action firearm. The slide cover device 1 includes a slide cover 2 having a front end 7, a rear end 8, a top or upper surface 2A, a right side 9A and a left side 9B (not shown), a forward cutout 5 for forward dot-sights, a middle cutout 6 for a cartridge ejection window and a rear cut out 4 for rear dot-sights. FIG. 1 also shows a press pin 3 that enters a right side cutout 100 that when fully inserted, terminates at left side cutout 200.

Figure 1B:
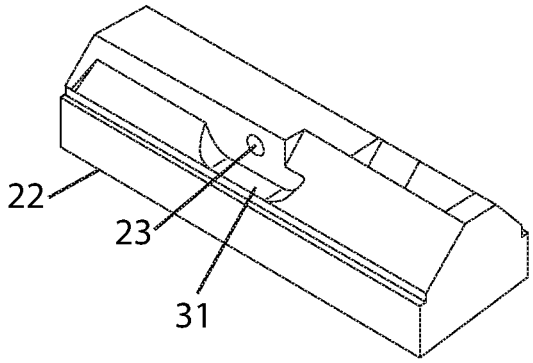
FIG. 1B is a perspective view of an exemplary factory slide mechanism without the slide cover.

With reference to FIGS. 1A and 1B, the factory slide cover 2 has upper surface 2A that is visible to the shooter and an underside 2B (not shown) that conforms to the upper surface profile of a sample factory slide 22 for a handgun. The factory slide 22 has a hole 23 having a diameter large enough to receive a press pin 3 to secure the slide cover 2 to the slide mechanism. Using careful machining tolerances between the diameter of pin 3, the diameter of the factory slide hole 23, and the diameter of the side holes 100, 200 in the slide cover 2, the inserted pin 3 secures the factory slide cover 2 to the factory slide 22.

Figures 2A, 2B, 2C:
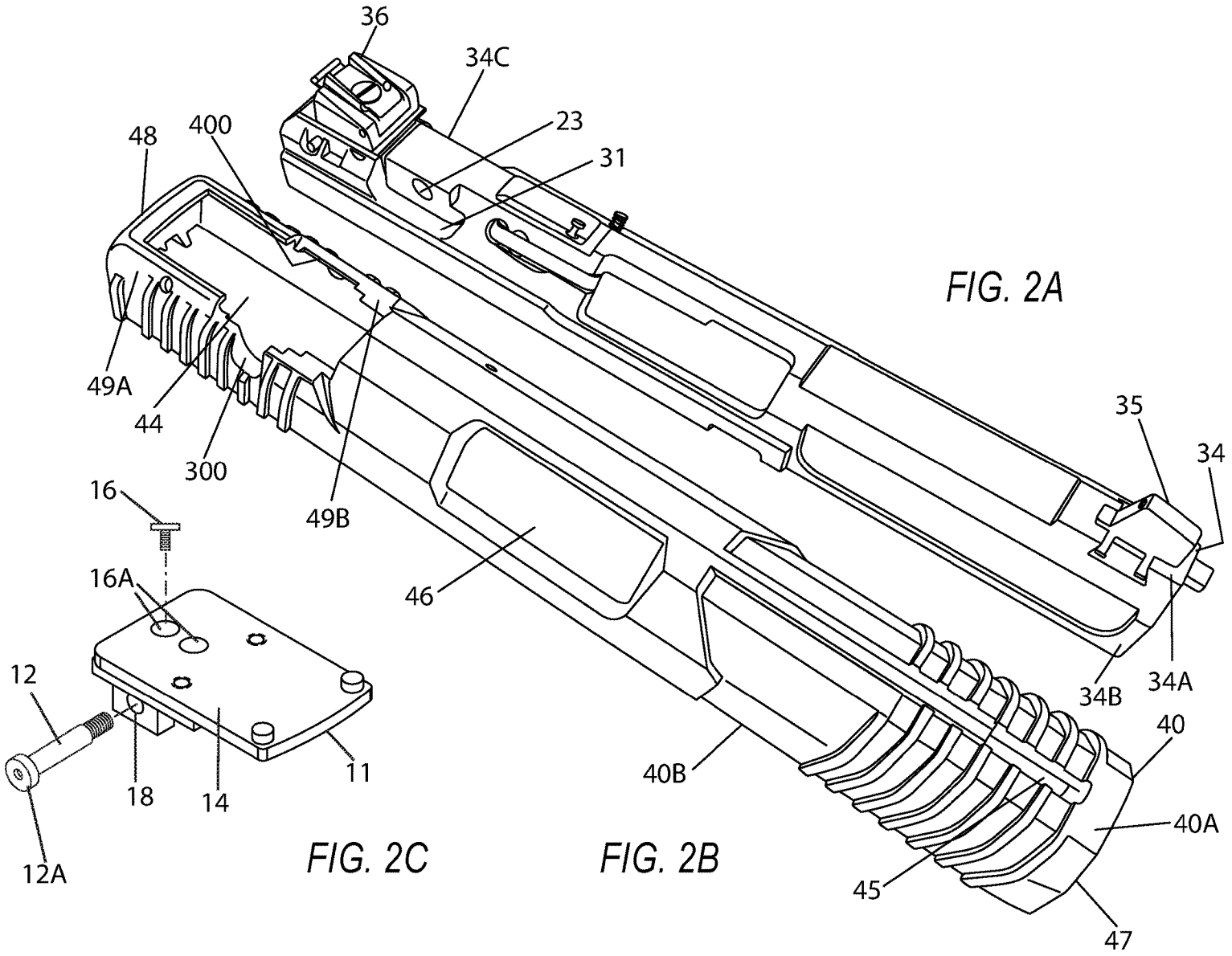
FIG. 2A is a perspective view of one embodiment of an unassembled factory slide mechanism having front and rear dot sights.
FIG. 2B is a perspective view of one embodiment of the present invention slide cover.
FIG. 2C is an enlarged perspective view of the upper surface of the removable mounting flange.

FIG. 2A illustrates a perspective view of a factory slide mechanism 34 having an upper surface 34A, a right side 34B, a left side 34C and an underside 34D (not shown). In this embodiment the factory slide mechanism 34 is illustrated with front dot sights 35 and rear dot sights 36. FIG. 2B illustrates a perspective view of the present invention unassembled slide cover 40. Similar to the factory slide mechanism 22, shown in FIG. 1B, the factory slide mechanism 34 also has a hole 23 having a diameter large enough to receive either press pin 3 or threaded flange fastener 12. Both the press pin 3 and flange fastener 12 hold the slide cover 2 and slide cover 40 on the respective slide mechanisms, 22 and 34. In one embodiment, the factory slide mechanism 34 is made of a rigid material such as metal or a factory alloy and accessories, such as but not limited to factory-standard dot sights, are secured directly to the upper surfaces of the factory slide mechanism 34. In one embodiment, accessories such as but not limited to a sight having a dove-tail flange mount may be machined into an area of the upper surface 34A of the factory slide mechanism 34.

Similar to FIG. 1 and the factory slide cover device 1, the slide cover 40 has a front end 47, a rear end 48, a top or upper surface 40A, a right side 49A and a left side 49B, a forward cutout 45 for forward dot-sights, a middle cutout 46 for a cartridge ejection window and an extended rear cut out 44 rear dot-sights. In this embodiment, the rear cutout 44 is extended to provide room for the mounting flange 11 shown and discussed below in regard to FIGS. 3-4.

FIG. 2B also shows a right side cutout 300 and left side cutout 400 that house a horizontal flange pin (not shown) when the slide cover 40 is installed. The slide cover 40 is fabricated from dense polymer material to reduce weight. In one embodiment, replacement of the dot-sight elements 35 and 36 requires first removal of the installed slide cover 40. In another embodiment, removal of the installed slide cover 40 is not required to replace the dot sights.

With continued reference to FIGS. 2A and 2B the slide cover 40 has upper surface 40A that is visible to the shooter and lower surface or an underside 40B (not shown) that conforms to the upper surface profile of a sample factory slide mechanism 34 for a handgun such as but not limited to the FN 5.7 pistol. The factory slide mechanism 34 has a hole 23 that when assembled is in alignment with both the side holes 100 and 200 of the factory slide cover 2 and the side holes 300 and 400 of the slide cover 40; said hole 23 having a diameter large enough to receive press pin 3 or flange fastener 12 to secure the slide cover 2 to the slide mechanism 22 or the slide cover 40 to the slide mechanism 34. As with the factory slide 1 of FIG. 1, a flange pin (not shown) secures the slide cover 40 to the factory slide mechanism 34.

Figure 3A:
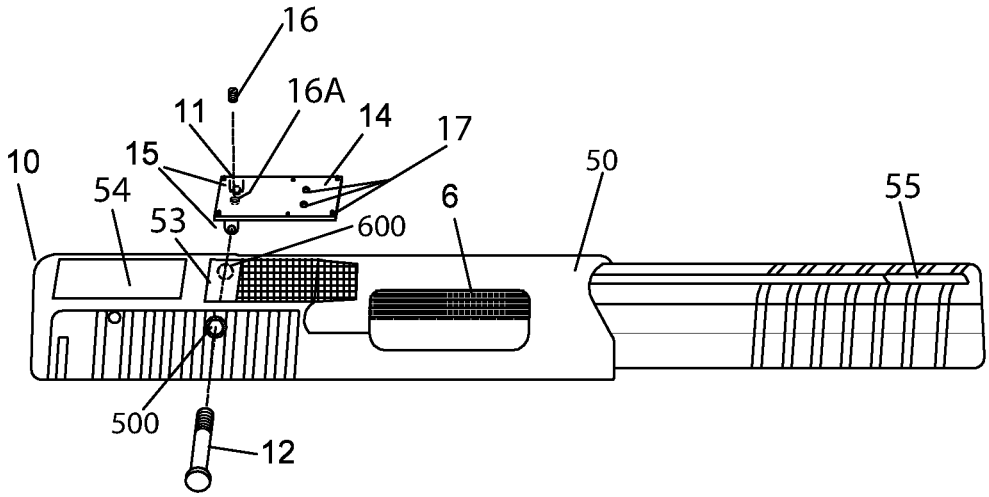
FIG. 3A is a top-left side perspective view of one embodiment of the present invention, an accessory attachment system comprising a slide cover, a mounting flange and a flange lock pin.

FIG. 2C illustrates an enlarged view of the top of the removable mounting flange 11. The flange top surface, upper surface or flange planar upper 14 of the accessory mounting flange 11 includes at least one pair of set screw holes 16A. In one embodiment, the set screw holes 16A are threaded and a set crew 16 having matching threads is inserted into each of the set crew holes to retain the slide cover 40 in place. In one embodiment, the set screw holes 16A are threaded and have inserted set screws 16 that when tightened, push on surface 34A of the factory slide, locking flange 11 in place while also putting pressure on flange fastener 12 so that the flange fastener 12 stays tight. Furthermore, by tightening and loosening set screws 16 to varying degrees, the tilt of flange 11 can be adjusted by pivoting, like a seesaw, flange 11 on one or more sides of flange fastener 12. In one embodiment, as shown in FIG. 3A the mounting flange 11 has only one set screw hole 16A. In another embodiment, there may be at least one set screw hole 16A. In another embodiment, there are at least one pair of set screw holes 16A.

In one embodiment. slide cover 40 is installed on factory slide 34. Then flange 11 is installed onto the assembly in extended rear cut out 44. Flange fastener 12 goes into side hole 300 through anchor leg hole 18 through factory slide mechanism hole 23, threads into left anchor leg hole 19, and terminates in side hole 400 in the slide cover. In one embodiment, the flange fastener 12 has a head 12A to retain the flange fastener 12 outside the side hole 300 of the slide cover 40.

FIG. 3A illustrates another embodiment of the present invention which is an alternate accessory attachment system 10 comprising slide cover 50, mounting flange 11 and mounting flange fastener or lock pin 12, for use with a factory-standard slide cover device 1 illustrated in FIG. 1. In this embodiment of the present invention, the accessory attachment system 10 has an underside substantially identical to the factory-standard underside since they are both designed to conform to the same profile of the upper side surface 34A of the factory slide mechanism 22 and/or factory slide mechanism 34 provided herein as examples. However, this embodiment of the accessory attachment system 10 of FIG. 3 illustrates additional features of the present invention including a removable accessory mounting flange 11, and a flange fastener 12. Similar to previous figures, the present invention shows a rear cutout 54 and forward cut-out 55 provided to accommodate the factory-standard rear dot-sights 36 and forward dot sights 35 often attached to the slide mechanism 34. Once the factory-standard slide cover 2 is removed, the accessory attachment system 10 is placed over exemplary factory slide mechanisms 22 and 34.

In continued reference to FIG. 3A, the removable accessory mounting flange 11 comprises an upper planar surface 14 containing a variety of fastening devices 17 such as but not limited to posts, guides, guideposts, screw holes and attachment points arrayed to match the pattern and design of fastening devices of the accessory to be attached. In one embodiment, the rigid removable metallic mounting flange 11 is readily removable or replaceable to accommodate the variety of mounting patterns of the mounting brackets of that may be unique to a particular accessory and/or manufacturer.

Figure 3B:
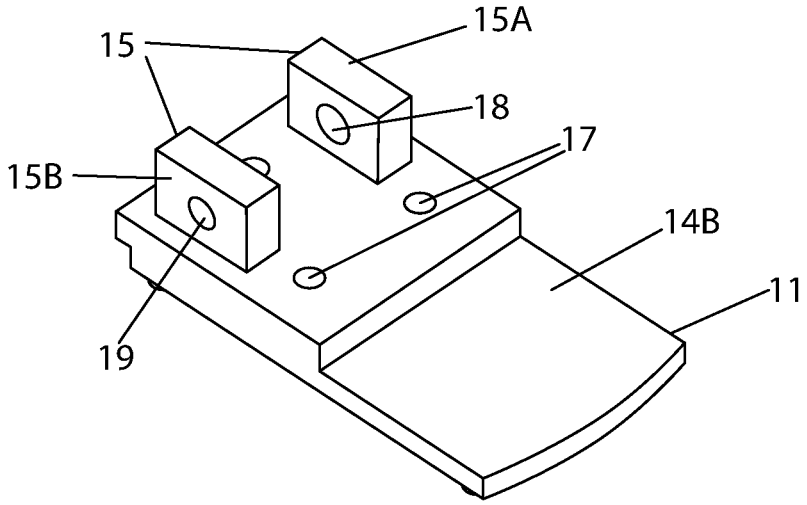
FIG. 3B is an enlarged perspective view of the lower surface of the removable mounting flange.

FIG. 3B illustrates an enlarged view of the bottom of the removable mounting flange 11. The flange bottom surface, lower surface or underside 14B of the accessory mounting flange 11 includes a pair of anchor legs 15 that extend below the flange underside 14B of the installed mounting flange 11. The pair of anchor legs 15 comprise right anchor leg 15A comprising a hole 18 and left anchor leg 15B comprising a hole 19. Right anchor leg a hole 18 and left anchor leg hole 19 aligns with right side hole 500 and left side hole 600 of the slide cover 50 similar to FIG. 1 left side hole 100 and right side hole 200 of slide cover 2.

It is notable that the alternate accessory attachment system 10 shown in FIG. 3 includes two sections rear cutout 54 which is distal to rear cutout 53 into which the anchor legs 15A and 15B are inserted when the accessory attachment system 10 is assembled and installed. This is a different embodiment than shown in FIG. 2B which illustrates an extended rear cut out 44. The extended rear cutout 44 of FIG. 2B provides similar space and performs similarly when attaching a rear dot sight 36 and/or mounting flange 11. In FIG. 2B, the rear cutout 44 is single enlarged or extended opening configured to house both rear dots sights 36 and the mounting flange 11. In FIGS. 3 and 4 two separate openings 53,54 and 63,63 respectively are illustrated and discussed.

With continued reference to FIG. 3A, when the mounting flange 11 is installed, each of the anchor legs 15A and 15B inserts into the second rear cutout 53 and are spaced to straddle the standard factory slide mechanism such as but not limited to the exemplary factory slide mechanisms 22 and 34 and secure slide cover 50 to the slide mechanism. Once the accessory removable mounting flange 11 is inserted into the rear cutout 53, the horizontal flange fastener 12 is inserted through the right side hole 500 of the slide cover 50, through the anchor leg hole 18 and exemplary factory slide hole 23, through the anchor leg hole 19 and secured into the right side hole 600.

The removable accessory mounting flange 11 comprises an upper planar surface 14 containing at least one additional fastening device that is a vertical fastener or set screw 16 used to tighten the connection between the mounting flange 11 and the slide cover 50 and the slide mechanism 34. The at least one set screw 16 further maintains the device's stability. In one assembled embodiment, a first set screw 16 is located in front of the inserted horizontal flange fastener 12 and a second set screw 16 is located behind the inserted horizontal flange fastener 12. When tightened the at least one set screw 16 passes through the mounting flange 11 in the direction of the underlying slide mechanism 34 and connects or abuts the upper surface of the slide mechanism 34A to secure any accessory attached to the upper planar surface 14 and the mounting flange 11 to the factory slide mechanism 34.

In one embodiment of FIG. 3, the horizontal flange fastener 12 is threaded on one end. In this embodiment, matching threads are provided into hole 500 of the right side of slide cover 50, anchor leg hole 18, factory slide mechanism hole 23, anchor leg hole 19 and left side hole 600 of the slide cover 50. In one embodiment, anchor leg 15A and 15B abut an inset planar section or ledge surface 31 of the slide mechanism 22 and/or 34. In this embodiment, the horizontal attachment fastener 12 is threaded and tightened into place using a conventional tool, such as but not limited to an Allen-wrench, or other torqueing tool known in the art. In a similar manner, the at least one set screw 16 is threaded and inserted into a set crew hole 16A in the mounting flange planar upper surface 14 having matching threads. As the at least one set screw 16 is tightened or torqued into the mounting flange hole 16A, the bottom side of the fastener is compressed in the direction of the upper surface 34A of the underlying slide mechanism 34 providing an additional force point to secure the mounting flange 11. The number of flange holes 16A is at least as many as the at least one set screw 16.

Figures 4A, 4B:
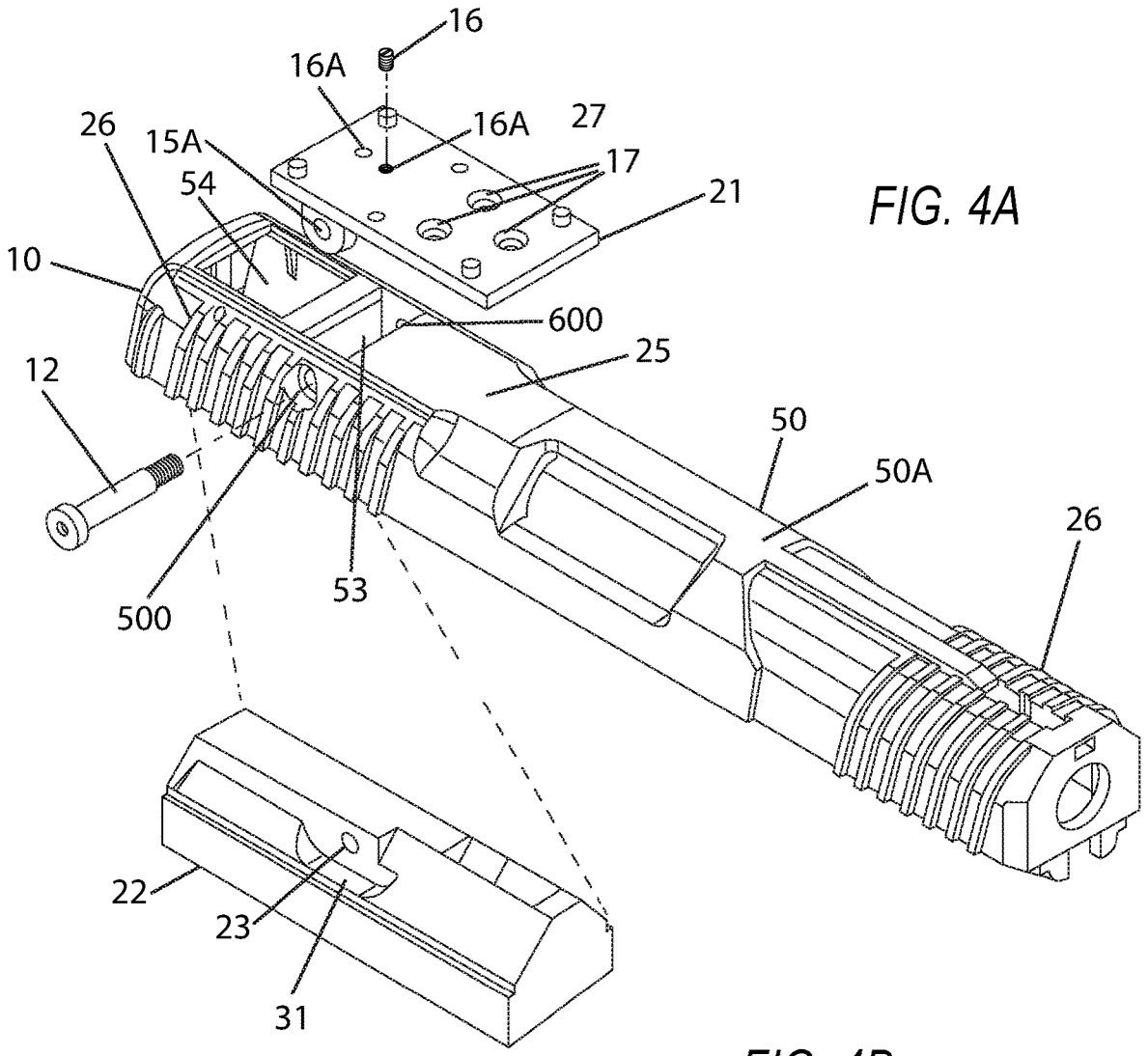
FIG. 4A is a perspective top-side view of one embodiment of the present invention, accessory attachment system comprising a slide cover, a mounting flange and a flange pin.
FIG. 4B is a perspective view of an embodiment of a factory slide without a slide cover.

FIG. 4A, illustrates another unassembled embodiment of the accessory attachment system 10 with slide cover 50, an alternate accessory mounting flange 21 and horizontal flange fastener 12. FIG. 4B illustrates a perspective view of an embodiment of an exemplary factory slide mechanism 22 without an installed accessory attachment system 10. The accessory mounting flange 21 is shown positioned above the second rear cutout 63 (explained above in relation to FIG. 3) into which alternate accessory mounting flange 21 is fitted in the assembled accessory attachment system.

An exemplary underlying slide mechanism 22 is shown as FIG. 4B; the slide mechanism 22 comprising a ledge or an inset planar section 31 located below a machined hole 23 through which a flange fastener 24 is inserted to secure the slide cover 50 to the slide 22. When the mounting flange 21 is inserted into the cut-out section 53, anchor legs 15A and 15B straddle the slide 22 on either side of the slide mechanism hole 23 and anchor legs 15A and 15B rest on the inset planar section 31 of the slide mechanism 22. After inserting the mounting flange 21, the anchor leg holes 18 and 19 align with the left side hole 500 and the right side hole 600 respectively, so that the horizontal fastener 12 can be inserted through right side the hole 500, the right anchor leg hole 18 through the slide mechanism hole 23 of the slide mechanism 22, through the left anchor leg hole 19 and tightened into receiving threads of the lefts side hole 600 of the slide cover 50.

In one embodiment, the accessory mounting flange fastener 12 is inserted into the assembled device system 10 such that it is counter-sunk to present a smooth profile to the exterior surface of the slide cover 50. To further improve the stability of the mounting flange 21 when secured in place, a horizontal surface pad 25 is provided that receives and supports the flat underside of the mounting flange 21. In addition to improving the functionality of the weapon by providing a readily adaptable accessory mounting surface to the top surface 50A of the slide cover 50, various grooving patterns 26 located on the front end and rear end of the slide cover 50 for improved grip and barrel aesthetics may be incorporated into the alternate slide cover 60 that also further enhance features of the weapon over the factory-standard configuration. In one embodiment, there are multiple grooving patterns 26. In another embodiment, the grooving patterns 26 are the same wherever they are located on the slide cover 50. In one embodiment, the groove patterns26 are different in different locations of the slide cover 50. Additionally, patches (not shown) are placed on the tips of the at least one set screw 16 to further hold them in place and prevent scratching the slide mechanism surface 34A. These patches can be made of a material such as but not limited to nylon or plastic.

In another representative embodiment, a readily removable accessory mounting flange 21 accessory provides for tactical advantages that enhance the use, operations, and remediation of the firearm using a variety of accessories custom designed and fitted to the firearm by the user in the field based upon situational variations. This separates the present invention illustrated in FIGS. 4*a* and 4B into at least three pieces: a slide cover 50, a removable metallic mounting flange 21 and an accessory flange fastener 12 that secures both the slide cover 50 and accessory and mounting flange 21 to the underlying slide mechanism 22. The rigid removable metallic mounting flange 21 is readily removable or replaceable to accommodate the variety of mounting patterns of accessories or mounting brackets for handgun accessories that may be unique to a particular accessory manufacturer.

In one embodiment, the invention includes a cover plate (not shown) to cover the rear cutout 53, and/or 63 and/or the section of extended rear cutout 44 into which the mounting flange 11 and/or 21 are installed. The cover plate can be used for protection of the inner workings of the handgun as well as aesthetics to improve the overall appearance of the handgun when the mounting flange 11 and/or mounting flange 21 is not in use but the slide cover 50 is installed.

In one embodiment, of the invention, the removable mounting flange 21 is readily removable or replaceable to accommodate a variety of mounting patterns that may be unique to a particular accessory and/or manufacturer. In one embodiment, the removable mounting flange 21 comprises two plates welded or mechanically attached together e.g., a top plate and bottom plate (not shown) that slidably connected one to the other to move the top plate forward and backward along the slide cover upper surface.

While various embodiments of the present invention have been described above, it should be understood that they have been presented by way of example only, and not of limitation. Likewise, the various diagrams may depict an example architectural or other configuration for the invention, which is provided to aid in understanding the features and functionality that can be included in the invention. The invention is not restricted to the illustrated example architectures or configurations, but the desired features can be implemented using a variety of alternative architectures and configurations.

Indeed, it will be apparent to one of skill in the art how alternative functional configurations can be implemented to implement the desired features of the present invention. Additionally, with regard to operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

What is claimed is:

1. A accessory attachment system for a slide-action handgun comprising:

a slide cover comprising:

a front end, a rear end, a top surface, a right side and a left side;

a right side cutout located on the right side of the slide cover that is aligned with a left side cutout located on the left side of the slide cover and a rear cutout in the top surface of the slide cover;

a mounting flange inserted into the rear cutout of the slide cover, said mounting flange comprising:

a top planar surface comprising fastening devices to attach various firearm accessories; and a bottom surface comprising a first anchor leg containing a hole and a second anchor leg containing a hole; wherein the first anchor leg hole and the second anchor leg hole are in alignment with the right side cutout and left side cutout of the slide cover and said anchor legs are spaced apart to straddle an underlying slide mechanism, said slide mechanism containing a hole in alignment with the right side cutout and left side cutout of the slide cover; and a flange lock pin inserted into the right side cutout, the first anchor leg hole, the hole of the underlying slide mechanism, the second anchor leg hole and the left side cutout of the slide cover.

2. The accessory attachment system of claim 1, wherein the rear cutout of the slide cover is enlarged for other accessories that attach to the slide mechanism.

3. The accessory attachment system of claim 1, further comprising a second rear cutout in the top surface of the slide cover for accessories that attach to the slide mechanism.

4. The accessory attachment system of claim 1, further comprising a side cut-out section that is in alignment with a shell ejection port of the slide mechanism.

5. The accessory attachment system of claim 1, wherein the flange lock pin and the left side cutout of the slide cover are threaded.

6. The accessory attachment system of claim 1, wherein the mounting flange is removable.

7. The accessory attachment system of claim 1, wherein the slide cover is made from a durable, lightweight polymer material.

8. The accessory attachment system of claim 1, further comprising a front cutout for other accessories that attach to the slide mechanism.

9. The accessory attachment system of claim 1, said mounting flange further comprising at least one set screw inserted into the top planar surface of the mounting flange.

10. The accessory attachment system of claim 1, said mounting flange further comprising at least two set screws inserted into the top planar surface of the mounting flange.

11. The accessory attachment system of claim 10, wherein one of the at least two set screws is inserted into the top planar surface of the mounting flange behind the inserted flange lock pin and the other of the at least two set screws is inserted into the top planar surface of the mounting flange in front of the inserted flange lock pin.

12. The accessory attachment system of claim 1, said slide cover further comprising various grooving patterns located on the front end and rear end of the slide.

13. A method for adapting mountable accessories to a slide-action handgun, comprising:

replacing a factory slide cover with an accessory attachment system comprising:

a slide cover comprising:

a front end, a rear end, a top surface, a right side and a left side;

a right side cutout located on the right side of the slide cover that is aligned with a left side cutout located on the left side of the slide cover and a rear cutout in the top surface of the slide cover;

a mounting flange inserted into the rear cutout of the slide cover, said mounting flange comprising:

a top planar surface comprising fastening devices to attach various firearm accessories; and a bottom surface comprising a first anchor leg containing a hole and a second anchor leg containing a hole; wherein the first anchor leg hole and the second anchor leg hole are in alignment with the right side cutout and left side cutout of the slide cover and said anchor legs are spaced apart to straddle an underlying slide mechanism, said slide mechanism containing a hole in alignment with the right side cutout and left side cutout of the slide cover; and a threaded flange lock pin inserted into the right side cutout, the first anchor leg hole, the hole of the underlying slide mechanism, the second anchor leg hole and the left side cutout of the slide cover;

securing an accessory to the top surface of the flange using the fastening devices; and securing the bottom surface of the flange to the slide mechanism by inserting the flange lock pin into the right side cutout, the first anchor leg hole, the hole of the underlying slide mechanism, the second anchor leg hole and the left side cutout of the slide cover.

14. The method of claim 13, wherein the fastening devices are configured to a pattern matching a mounting bracket of a specific firearm accessory.

15. The method of claim 14, further comprising:

unfastening the accessory from the mounting flange and removing the accessory from the firearm;

removing the threaded flange lock pin and removing the mounting flange from the rear cutout;

replacing the mounting flange with a second mounting flange configured to a different fastening pattern matched to an alternate accessory;

inserting the flange lock pin into the right side cutout, the first anchor leg hole, the hole of the underlying slide mechanism, the second anchor leg hole and the left side cutout of the slide cover; and securing the alternate accessory to the second mounting flange.

* * * * *